US010611015B2

(12) United States Patent
Baskar et al.

(10) Patent No.: US 10,611,015 B2
(45) Date of Patent: Apr. 7, 2020

(54) ADJUSTABLE AND FLEXIBLE HOOD PANEL SUPPORT

(71) Applicant: FORD GLOBAL TECHNOLOGIES, LLC, Dearborn, MI (US)

(72) Inventors: Shunmugam Baskar, West Bloomfield, MI (US); Michael J. Gardynik, Farmington Hills, MI (US); Christopher Pope, Macomb, MI (US); Christina Dung Nguyen, Northville, MI (US); Venkatasamy Veluchamy, Rochester Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 523 days.

(21) Appl. No.: 14/967,464

(22) Filed: Dec. 14, 2015

(65) Prior Publication Data

US 2017/0165826 A1 Jun. 15, 2017

(51) Int. Cl.

| | |
|---|---|
| ***B25H 1/00*** | (2006.01) |
| ***B25B 11/00*** | (2006.01) |
| ***B25B 13/02*** | (2006.01) |
| ***B05B 13/02*** | (2006.01) |
| ***E05C 21/00*** | (2006.01) |

(52) U.S. Cl.

CPC ..... *B25H 1/00* (2013.01); *B05B 13/0285* (2013.01); *B05B 13/0292* (2013.01); *B25B 11/00* (2013.01); *E05C 21/005* (2013.01)

(58) Field of Classification Search

None

See application file for complete search history.

(56) References Cited

U.S. PATENT DOCUMENTS

| | | | | |
|---|---|---|---|---|
| 4,253,210 A * | 3/1981 | Racicot | E04C 3/08 14/13 |
| 5,556,084 A * | 9/1996 | Hodges | B25H 1/0007 254/DIG. 16 |
| 5,660,637 A * | 8/1997 | Dodge | B05B 13/0285 118/500 |
| 5,720,817 A * | 2/1998 | Taylor | B05B 13/0285 118/500 |

(Continued)

FOREIGN PATENT DOCUMENTS

| | | |
|---|---|---|
| CN | 201482694 U | 5/2010 |
| JP | 2002233799 A | 8/2002 |

*Primary Examiner* — Brian D Keller

(74) *Attorney, Agent, or Firm* — Vichit Chea; Brooks Kushman P.C.

(57) ABSTRACT

An apparatus for holding a hood of a vehicle open during e-coat application and painting. The apparatus includes a support incorporating first and second pairs of legs attached to spaced locations on right and left sides of an engine compartment. The two pairs of legs are connected at an upper portion of the legs. A hood support bar is connected to the upper portion of both the first and second pairs of legs and extends transversely across the engine compartment. A hood striker receiving bracket may be provided on the hood support bar. The apparatus is adjustable to position the hood striker receiving bracket in a range of vertical, transverse and longitudinal locations. The adjustability of the apparatus provides a flexible hood support that reduces thermal distortion or sag due to thermal load.

8 Claims, 4 Drawing Sheets

(56) References Cited

U.S. PATENT DOCUMENTS

| | | | | |
|---|---|---|---|---|
| 6,435,360 | B1 * | 8/2002 | Buchmeier | B66C 1/10 212/180 |
| 7,988,137 | B2 * | 8/2011 | Johnson | B25H 1/0007 248/164 |
| 8,770,561 | B2 | 7/2014 | Gagnon, Jr. | |
| 2006/0086317 | A1 | 4/2006 | Fiedler | |
| 2007/0022950 | A1 | 2/2007 | Livingston | |

* cited by examiner

ADJUSTABLE AND FLEXIBLE HOOD PANEL SUPPORT

TECHNICAL FIELD

This disclosure relates to a hood panel support used in the vehicle assembly process to hold open the hood panel during electro-coating and painting operations.

BACKGROUND

Vehicle bodies are assembled together to form what is commonly referred to as a body-in-white that is treated by electro-coating (hereinafter "E-coat") to prevent corrosion. The body-in-white is painted prior to assembling the body to the chassis and frame. The hood panel is held in its raised position to provide access to the areas below the hood and assure adequate coverage when the body-in-white is E-coated and painted.

Parts of the body-in-white undergo thermal expansion in the paint system ovens and contraction as the parts cool. Thermal strain induced on the parts may potentially lead to distortion of the part. Thermal expansion of the hood panel may result in sagging or deflection caused by the force of gravity on the panel.

Adhesives used to bond parts together have a low modulus at ambient temperature but are cured in ovens to have a high modulus. Heat transfer to the adhesive deposits on parts is important to assuring that the adhesives cure completely.

Parts must be well supported in E-coat baths and in the paint ovens to minimize/eliminate movement during heating to avoid distortion. Distortion of the hood panel may require repair and may detract from the appearance of the vehicle.

The above problems and other problems are addressed by this disclosure as summarized below.

SUMMARY

According to one aspect of this disclosure, an apparatus is disclosed for holding a hood of a vehicle open during e-coat application and painting. The apparatus includes two supports attached to spaced locations on right and left sides of an engine compartment. Each support has two legs and the two pairs of supports are connected at an upper portion of each leg. A hood support bar is connected to the upper portion of both the first and second pairs of supports and extends transversely across the engine compartment. A hood striker receiving bracket is provided on the hood support bar.

According to other aspects of this disclosure, the hood support bar may be adapted to be adjusted in all directions, longitudinal "L" (fore/aft), transverse "T" (in/out), and vertical "V" (up/down). A leg connector may be attached to a top portion of each pair of legs that holds the upper portion of the legs in a spaced relationship to be adjusted in a vertical direction, and similarly, the horizontal flanges on the hood support bar are provided to adjust in longitudinal and lateral directions. The flange may define a slot that extends vertically, horizontally or laterally and a fastener may secure the hood support bar at a selected location within the slot.

Alternatively, a pair of tubular sleeve connectors may be secured to an upper portion of one of the legs of each of the pairs of legs, wherein the tubular sleeve connectors are attached to outer lateral portions of the hood support bar, and wherein a fastener secures the hood support bar to the upper portion of one of the legs in a range of vertical locations.

The hood support bar may be arch-shaped and may be raised in a central portion thereof relative to locations where the hood support bar is connected to the upper portions of the legs.

The hood striker receiving bracket may be disposed in a V-shaped central recess formed in the hood support bar.

The hood support bar may be a truss assembly including a planar bar and risers extending between the planar bar and a plurality of landing pads. The hood striker receiving bracket may be assembled between two landing pads above the center of the planar bar.

According to another aspect of this disclosure, a hood prop assembly is provided for a vehicle that comprises right and left side inverted V-shaped risers and a transverse support bar. The transverse (lateral) support bar is assembled to an upper portion of each of the inverted V-shaped risers that are detachably secured to an edge of a hood opening defined by the vehicle and hold a hood panel spaced from the hood opening.

The transverse support bar may be adapted to be connected to the upper portion of the right and left side inverted V-shaped risers in a range of heights. A leg connector may be attached to a top portion of each of the right and left side inverted V-shaped risers to hold the upper portion of the risers in a spaced relationship. The leg connector extends in a longitudinal direction away from the upper portion to a flange provided on the transverse support bar that extends in a vertical direction. A slot may be defined by the flange to extend vertically and wherein a fastener secures the transverse support bar at a selected location within the slot.

A pair of tubular sleeve connectors may be secured to an upper portion of the right and left side inverted V-shaped risers, wherein the tubular sleeve connectors are attached to outer lateral portions of the transverse support bar, and wherein a fastener secures the transverse support bar to the upper portion of the right and left side inverted V-shaped risers in a range of vertical locations.

The transverse support bar may be arch-shaped and may be elevated in a central portion thereof relative to locations where the transverse support bar is connected to the upper portions of the risers.

The hood prop assembly may further comprise a hood latch connector disposed in a V-shaped central recess formed in the transverse support bar.

The transverse support bar may be a truss assembly including a planar bar including risers extending between the planar bar and a plurality of landing pads. A hood striker receiving bracket may be assembled between two landing pads above the center of the planar bar.

The above aspects and other aspects of this disclosure are described below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
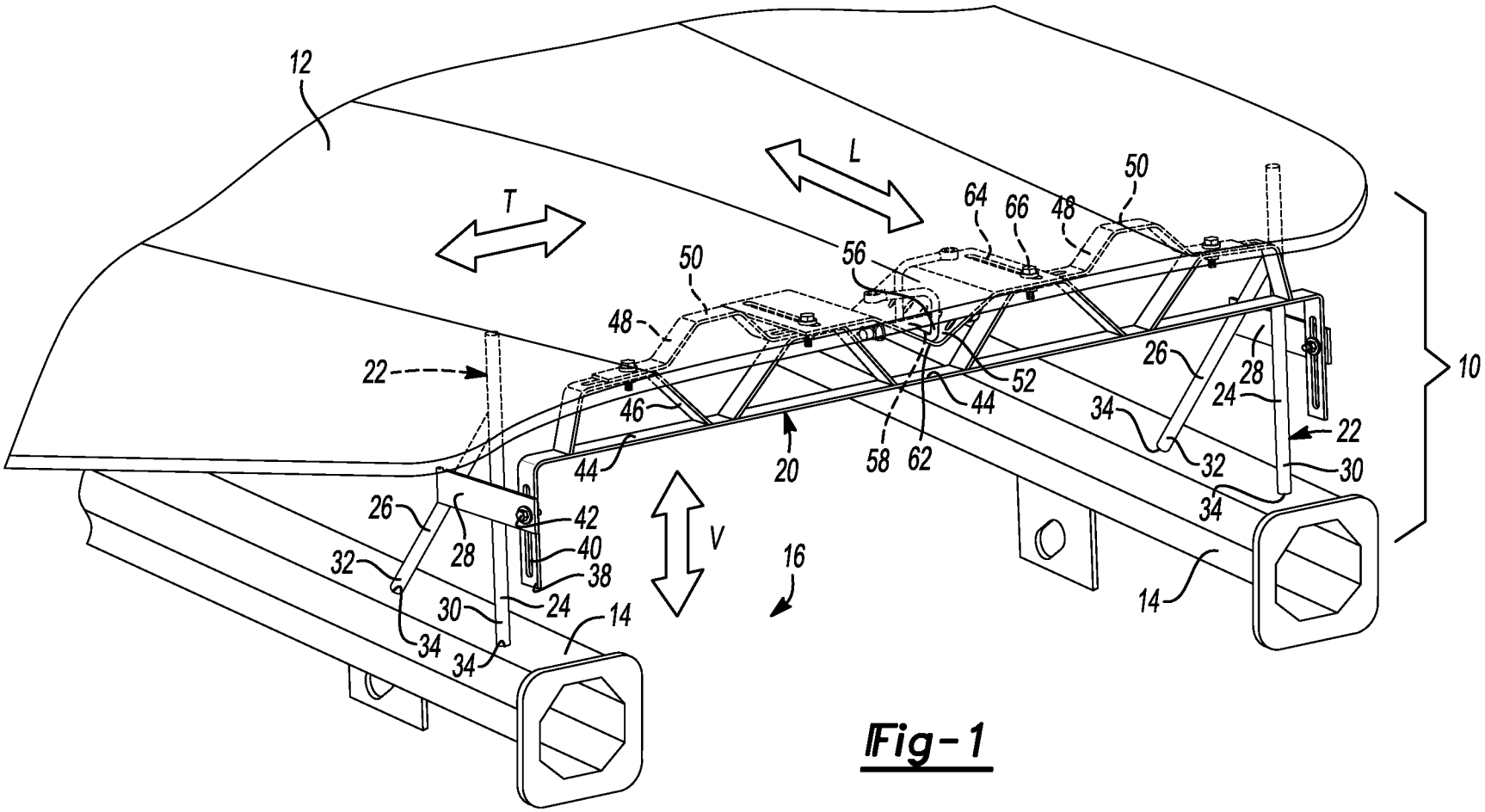
FIG. 1 is a fragmentary perspective view of a hood panel support holding a hood of a vehicle above side rails of the vehicle engine compartment.
Figure 2:
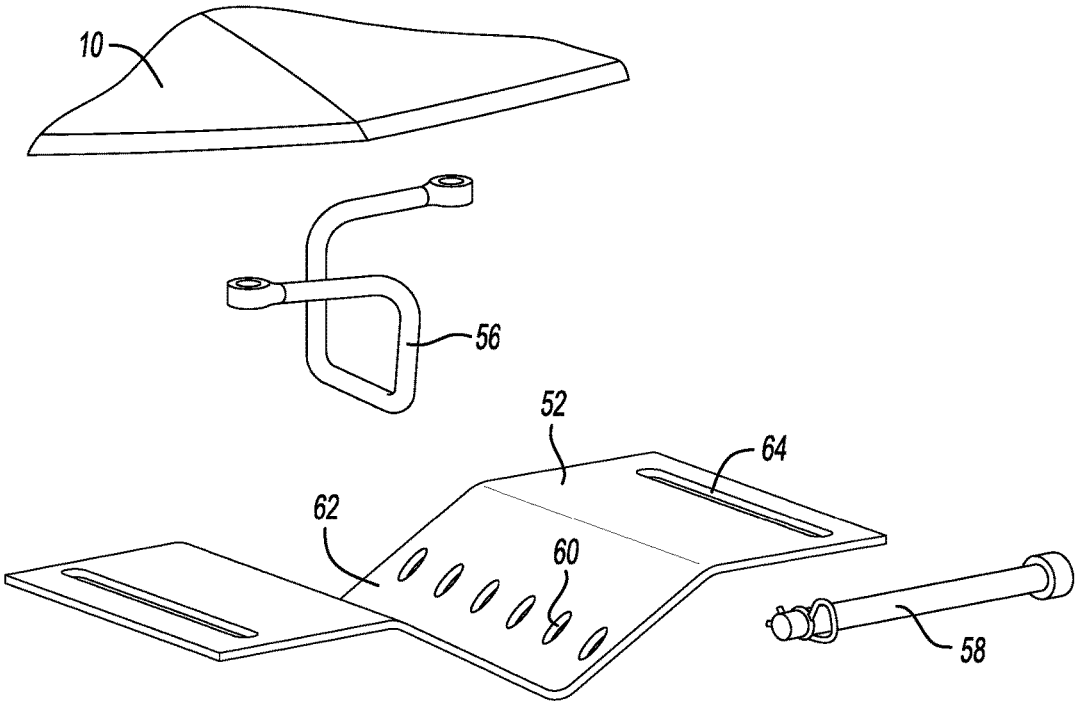
FIG. 2 is an exploded perspective view of a hood striker receiving bracket, hood, striker and pin.
Figure 3:
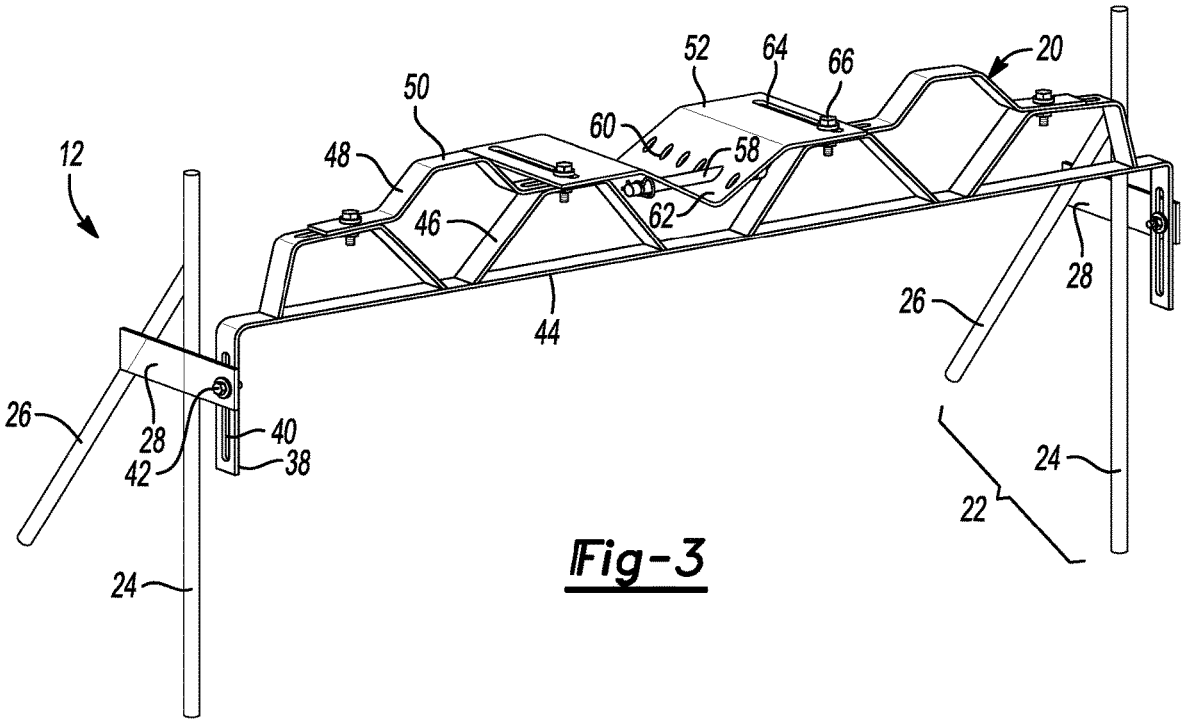
FIG. 3 is a perspective view of a hood panel support made according to one embodiment of this disclosure.

Referring to FIGS. 1-3, one embodiment of a hood panel support 10 is shown supporting a hood 12 above a pair of spaced front rails 14. The front rails 14 are provided on right and left sides of an engine compartment 16. The hood panel support 10, shown in FIG. 1, includes a truss cross bar 20 that is support by a pair of support legs 22 that are, in turn, supported on the front rails 14. The pair of support legs 22 on the right and left sides of the engine compartment 16 includes a front leg 24 and a rear leg 26 and extends vertically. The front leg 24, as illustrated, extends in the vertical direction (indicated by the arrow "V"), while the rear leg 26 extends between the front rails 14 and the front leg 24 at an angle. It should be understood that the angle of the front leg 24 and rear leg 26 relative to the front rails 14 may be changed to another angular relationship.

The front leg 24 and rear leg 26 are connected by a leg connector 28 that is a rigid member capable of holding the front leg 24 and rear leg 26 in a desired orientation and height. The front leg 24 includes a lower end 30 and the rear leg 26 includes a rear end 32. The lower ends 30 and 32 are received in an opening 34 on the front rails 14. It should be understood that instead of an opening 34, a receptacle could be provided on the front rails 14 that is capable of supporting the front leg 24 and rear leg 26 at a desired location on the front rails 14.

The truss cross bar 20 includes a height adjustment leg 38 on both right and left ends that also provides for adjustments in the vertical direction "V" thereof. A vertical adjustment slot 40 is provided that receives a fastener 42 used to locate the height adjustment leg relative to the leg connector 28. The fastener 42 extends through openings (not shown) in the leg connectors 28. The truss cross bar 20 is adjustable to a desired height and the fasteners 42 may be used to hold the truss cross bar 20 at the desired height.

The truss cross bar 20 includes a transversely extending base bar 44 that extends between the height adjustment legs 38 on opposite sides of the base bar 44. Truss spacers 46 may be provided to reinforce the base bar 44. The truss spacers 46 may include a landing pad bracket 48 that is attached to the truss spacers 46 and provide a landing pad 50, or raised surface, that is spaced above the base bar 44 and truss spacers 46. The landing pad is adapted to provide a resting location for the hood 12 on the truss cross bar 20.

A hood striker receiving bracket 52 is shown connected to two truss spacers 46 and between two landing pad brackets 48. The location of the landing pads 50 may be adjusted in the transverse vehicle direction "T" by shifting the connection point of the landing pad brackets 48 relative to the truss spacers 46. The fasteners are inserted at the connection point in the slot on top of the truss spacers 46.

The hood striker receiving bracket 52 receives the hood 12 that includes a striker 56. The striker 56 is used to secure the hood 12 to the truss cross bar 20. A retainer pin 58 may be attached to one or more openings 60 in the hood striker receiving bracket 52. The retainer pin 58 is inserted through one or more openings and the striker 56 to hold the hood 12 as it is processed through electro-coating and painting.

The hood striker receiving bracket 52 includes a V-shaped plate 62. The V-shaped plate 62 is secured to the truss cross bar 20 and is part of the hood striker receiving bracket. The V-shaped plate 62 may be secured to the truss cross bar 20 in a range of fore-and-aft locations, or longitudinal location, and secured in the desired location by a fastener 66. The longitudinal adjustment slot 64, or the selection of openings 60 in the hood striker receiving bracket 52, can be used alone or together to permit longitudinal adjustment in the direction shown by arrow "L" where the striker 56 may be secured by the retainer pin 58.

Figure 4:
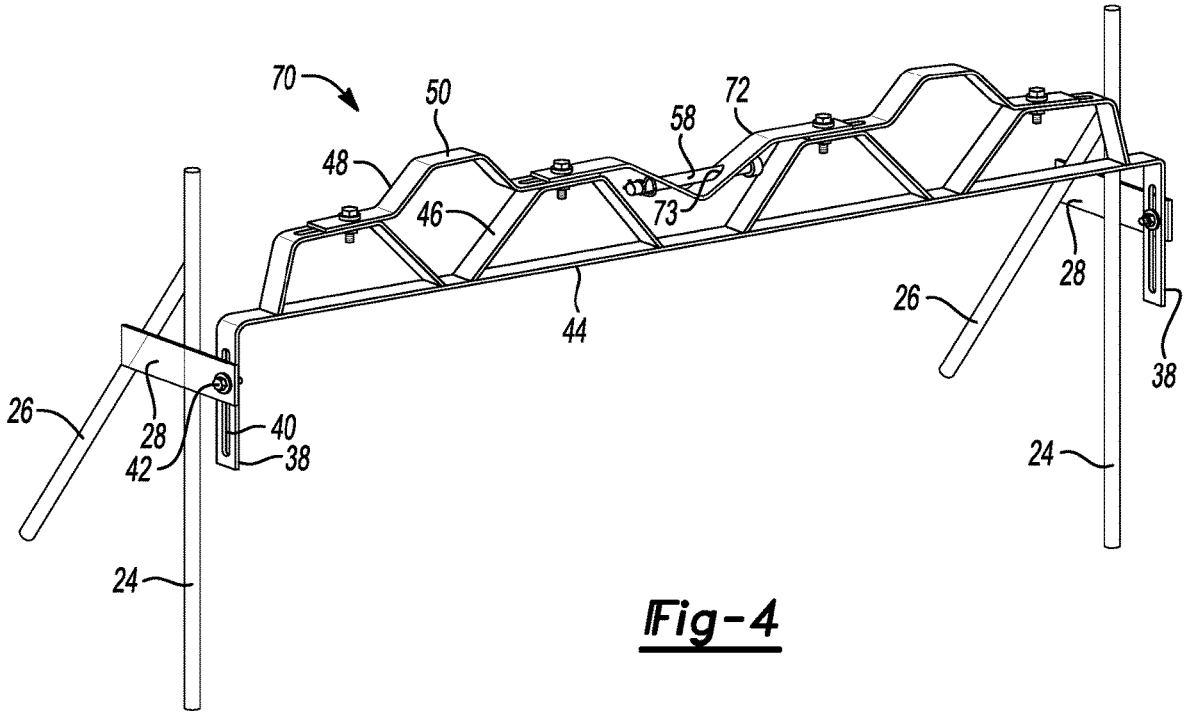
FIG. 4 is a hood panel support made according to another embodiment of this disclosure.

Referring to FIG. 4, an alternative hood panel support 70 is illustrated that is more compact, but does not include a longitudinal adjustment feature. The reference numerals for parts described with reference to the embodiments of FIGS. 1-3 are carried over in the embodiments shown in FIGS. 4-7.

The alternative hood panel support 70 includes the truss cross bar 20 that is supported on a pair of legs 22 that each includes a front leg 24 and a rear leg 26. The height of the truss cross bar 20 is adjustable as the result of providing a height adjustment leg 38 including the vertical adjustment slot 40 and the fastener 42 on opposite sides of the truss cross bar 20. The truss cross bar 20 includes the base bar 44, truss spacers 46 and a landing pad bracket 48, as previously described with reference to FIGS. 1-3.

The landing pad bracket 48 includes a landing pad 50 upon which the hood 12 may rest during the electro-coating and painting processes. A V-shaped bracket 72 includes a pair of openings that receive the retainer pin 58. The retainer pin 58 is inserted to retain the striker 56 on the V-shaped bracket 72. While the embodiment of FIG. 4 does not include a longitudinal adjustment feature, it offers the advantage of being more compact and providing better access to the lower side of the hood 12 during the electro-coating and painting process.

Figure 5:
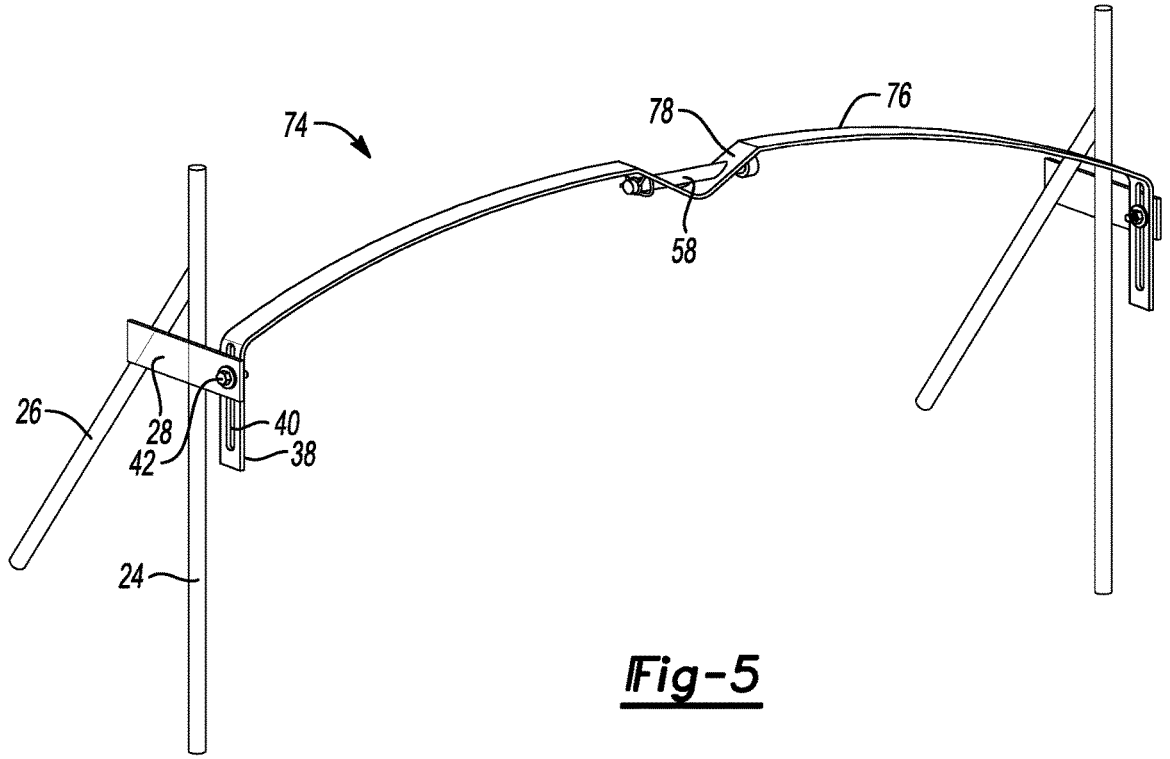
FIG. 5 is a perspective view of a hood panel support made according to another embodiment of this disclosure.

Referring to FIG. 5, an arcuate hood panel support 74 is illustrated that includes a convex cross bar 76 including a V-shaped portion 78 in the center of the cross bar 76 that is adapted to receive the retainer pin 58. The pin 58 attaches the hood 12 and striker 56 (shown in FIGS. 1-3) to the V-shaped portion of the cross bar 76. The arcuate hood panel support 74 is supported on right and left sides by a pair of legs 22 including a front leg 24 and a rear leg 26 that are held in a desired relationship by the leg connector 28. The height of the cross bar 76 is adjustable by changing the height at which the height adjustment leg 38 is secured to the leg connector 28 by changing the attachment location of the fastener 42 in the vertical adjustment slot 40.

Figure 6:
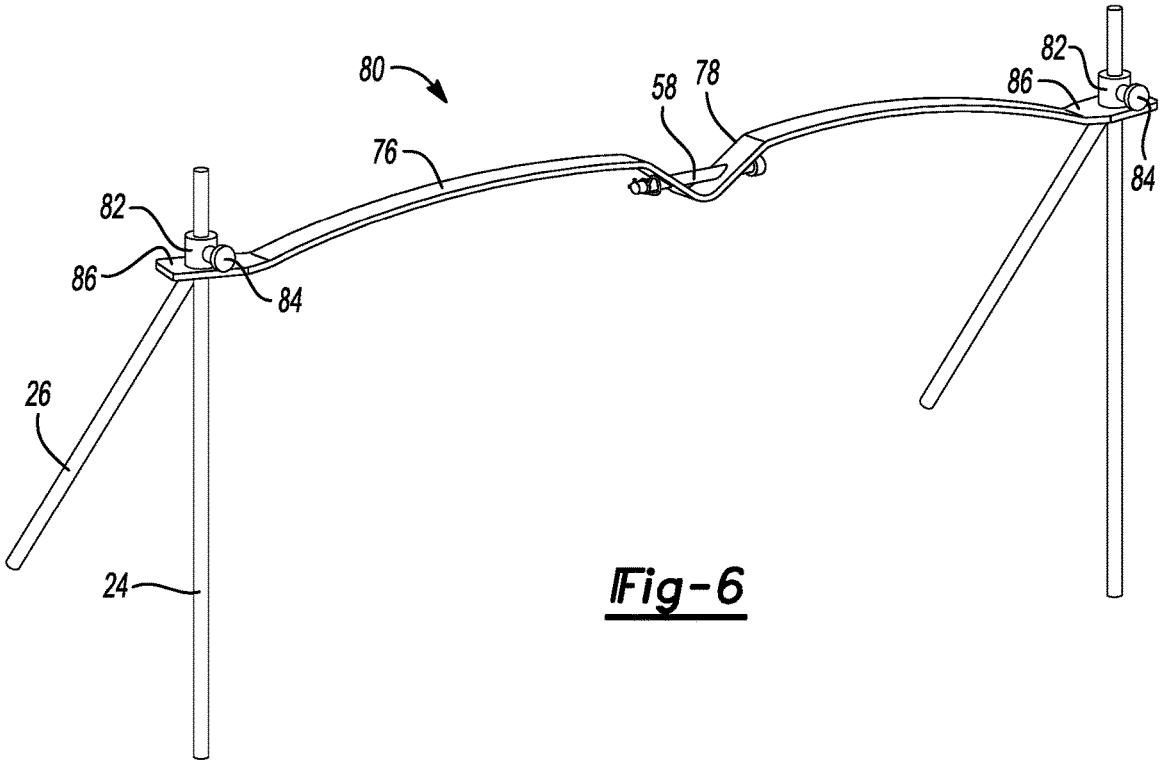
FIG. 6 is a perspective view of a hood panel support made according to another embodiment of this disclosure.

Referring to FIG. 6, another embodiment of an arcuate hood panel support 80 is illustrated that includes the arcuate convex cross bar 76 and V-shaped portion 78, as described with reference to FIG. 5. The pin 58 is attached to the V-shaped portion and is used to secure the hood 12 and striker 56 (shown in FIGS. 1-3) to the hood panel support 80. In the embodiment of FIG. 6, a tubular connector 82 is provided that includes a thumb screw 84, or other type fastener that would permit adjustment of the location of the tubular connector 82 relative to the front leg 24. The tubular connector 82 is connected to the front leg 24 within a range of heights and may be secured by the thumb screw 84 at the desired height. A mounting flange 86 is provided on opposite ends of the cross bar 76. The mounting flange 86 includes a hole (not shown) in which the front leg 24 is received. The height of the hood panel support 80 may be simply adjusted by loosening the thumb screw 84 and shifting the location of the tubular connector 82 on the front leg 24.

Figure 7:
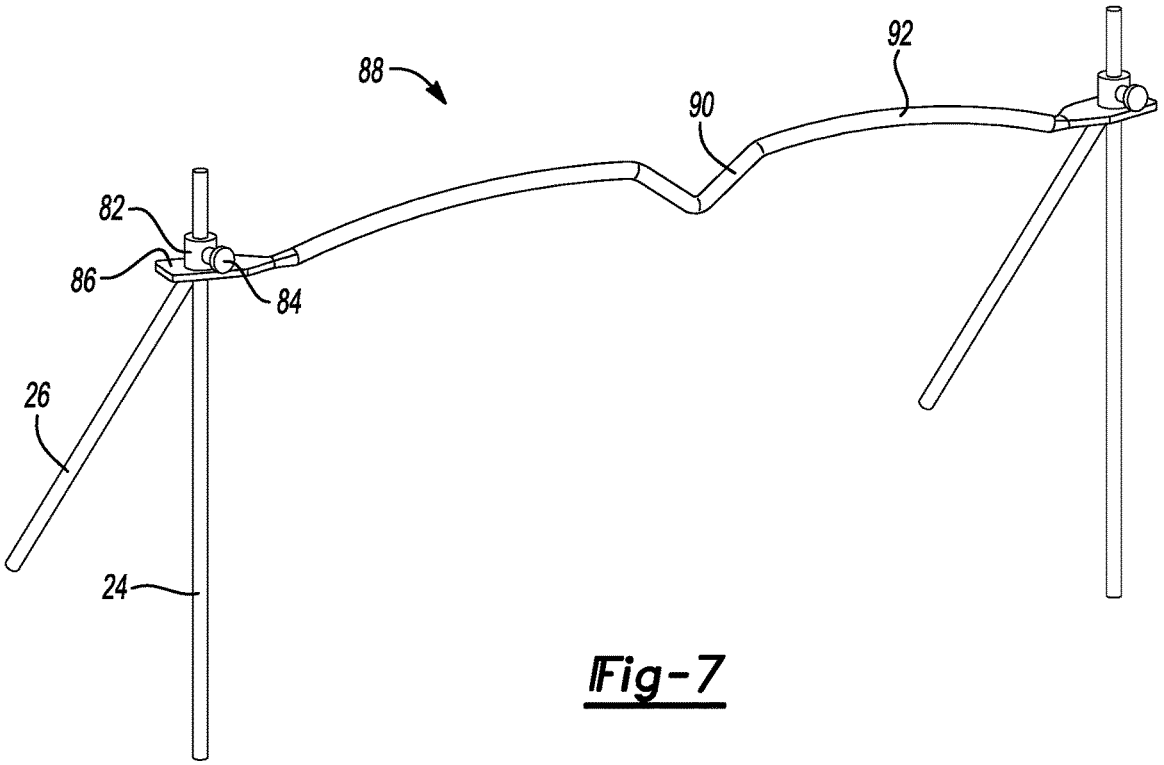
FIG. 7 is a perspective view of a hood panel support including tubular sleeve connectors and a rod-shaped cross member.

Referring to FIG. 7, another embodiment of a cylindrical hood panel support 88 is illustrated that includes a cylindrical arcuate cross bar 90. The cross bar 90 may be a tubular cross bar, or may be formed from a solid rod. The cross bar 90 is connected to the front leg 24 and rear leg 26 by the tubular connector 82 and thumb screw 84. The tubular connector 82 is secured by the screw 84 at a desired height on the first leg 24. The mounting flange 86, shown in FIG. 6, is also provided on both ends of the cylindrical arcuate cross bar 90 that receives the top end of the front leg 24, as previously described.

A V-shaped bend 92 is provided in a central portion of the cross bar 90. The hood panel support 88 is adjustable in height by adjusting the location of the tubular connector on the front leg 24. In the embodiment shown in FIG. 7, no provision is made for receiving the retainer pin 58, as described with reference to the above embodiments. In this embodiment, it is anticipated that the hood 12 may be positioned at its maximum open position and the striker 56 would be received in a space defined by the V-shaped bend 92. The arcuate cross bar 90 would then be positioned to hold the hood 12 in its maximum open position.

The embodiments described above are specific examples that do not describe all possible forms of the disclosure. The features of the illustrated embodiments may be combined to form further embodiments of the disclosed concepts. The words used in the specification are words of description rather than limitation. The scope of the following claims is broader than the specifically disclosed embodiments and also includes modifications of the illustrated embodiments.

What is claimed is:

1. An apparatus comprising:

first and second pairs of legs attached to spaced locations on right and left sides of an engine compartment and connected at an upper portion of the legs; and a support bar connected to the upper portion of the first and second pairs of legs extends transversely across the engine compartment and configured to support a hood, the support bar defining a hood striker receiving area and a pair of landing pads.

2. The apparatus of claim 1 wherein the support bar is adapted to be connected to the upper portion of the first and second pairs of legs to be adjustable in a range of heights.

3. The apparatus of claim 2 further comprising:

a leg connector attached to a top portion of each pair of legs that holds the upper portion of the legs in a spaced relationship, and wherein the leg connector extends in a horizontal direction to a height adjustment leg provided on the support bar that extends in a vertical direction.

4. The apparatus of claim 3 wherein a slot is defined by the height adjustment leg to extend vertically and wherein a fastener secures the support bar at a selected location within the slot.

5. The apparatus of claim 1 further comprising:

a hood of a vehicle that includes a striker rod attached to the hood, wherein the striker rod is received in a recess formed in the support bar.

6. The apparatus of claim 1 wherein the support bar is a truss assembly including a planar bar including truss spacers extending between the planar bar and a plurality of landing pads assembled to the truss spacers, and wherein the hood latch receiving area is disposed between two landing pads, wherein the landing pads are adjustable to contact a hood in a range of locations spaced along the length of the truss assembly and the hood latch receiving area may be adjustable along the length of the truss assembly.

7. An apparatus in combination with a vehicle having a hood comprising:

first and second pairs of legs attached to spaced locations on right and left sides of an engine compartment and connected at an upper portion of the legs;

a support bar connected to the upper portion of the first and second pairs of legs extends transversely across the engine compartment and configured to support the hood, the support bar defining a hood striker receiving area and a pair of landing pads; and a striker rod attached to the hood and configured to be received in a V-shaped recess defined by a hood striker receiving bracket that defines the hood striker receiving area when the hood is supported by the apparatus.

8. The apparatus of claim 7 wherein a retainer pin is attached to the support bar and selectively and positively retains the striker rod in the V-shaped recess.

* * * * *